US010573254B2

(12) United States Patent
Yoshiga et al.

(10) Patent No.: US 10,573,254 B2
(45) Date of Patent: Feb. 25, 2020

(54) MEMORY IN PIXEL DISPLAY DEVICE WITH LOW POWER CONSUMPTION

(71) Applicant: InnoLux Corporation, Miao-Li County (TW)

(72) Inventors: Masahiro Yoshiga, Miao-Li County (TW); Kazuyuki Hashimoto, Miao-Li County (TW)

(73) Assignee: InnoLux Corporation, Miao-Li County (TW)

( * ) Notice: Subject to any disclaimer, the term of this patent is extended or adjusted under 35 U.S.C. 154(b) by 58 days.

(21) Appl. No.: 15/725,293

(22) Filed: Oct. 5, 2017

(65) Prior Publication Data

US 2019/0108799 A1 Apr. 11, 2019

(51) Int. Cl.

| | |
|---|---|
| ***G09G 3/34*** | (2006.01) |
| ***G09G 3/30*** | (2006.01) |
| ***H05B 33/08*** | (2020.01) |
| ***G09G 3/36*** | (2006.01) |
| ***G09G 3/20*** | (2006.01) |

(52) U.S. Cl.

CPC ..... *G09G 3/3426* (2013.01); *G09G 3/20* (2013.01); *G09G 3/30* (2013.01); *G09G 3/3677* (2013.01); *H05B 33/08* (2013.01); *G09G 2300/0809* (2013.01); *G09G 2300/0842* (2013.01)

(58) Field of Classification Search

CPC ..... G09G 3/3426; G09G 3/3677; G09G 3/30; G09G 3/3258; H05B 33/08; G02F 1/136286

See application file for complete search history.

(56) References Cited

U.S. PATENT DOCUMENTS

| | | | | |
|---|---|---|---|---|
| 6,778,162 | B2 | 8/2004 | Kimura | |
| 8,164,550 | B2 | 4/2012 | Miyazawa | |
| 2003/0016201 | A1* | 1/2003 | Ayres | G09G 3/3291 345/98 |
| 2013/0322159 | A1* | 12/2013 | Pelley | G11C 11/413 365/154 |
| 2014/0320482 | A1* | 10/2014 | Kawanaka | G09G 3/3659 345/214 |
| 2016/0328076 | A1* | 11/2016 | Pan | G06F 3/0416 |
| 2017/0169796 | A1* | 6/2017 | Tai | G09G 3/3233 |

* cited by examiner

*Primary Examiner* — Allen L Parker
*Assistant Examiner* — Gustavo G Ramallo
(74) *Attorney, Agent, or Firm* — Winston Hsu

(57) ABSTRACT

A pixel circuit includes a pixel control unit, a first switching unit, a second switching unit, an inverter, a memory capacitor, and a pixel capacitor. The pixel control unit is coupled to a source line and a gate line. The first switching unit has a first terminal coupled to the pixel control unit, and a second terminal. The inverter has an input terminal coupled to the second terminal of the first switching unit, and an output terminal. The memory capacitor is coupled to the first terminal of the first switching unit and receives a first voltage or a second voltage higher than the first voltage. The second switching unit has a first terminal coupled to the pixel control unit, and a second terminal coupled to the output terminal of the inverter. The pixel capacitor is coupled to a common line and the output terminal of the inverter.

20 Claims, 8 Drawing Sheets

MEMORY IN PIXEL DISPLAY DEVICE WITH LOW POWER CONSUMPTION

BACKGROUND OF THE DISCLOSURE

1. Field of the Disclosure

The present disclosure is related to a display device, and more particularly to a display device with low impedance.

2. Description of the Prior Art

Display devices have been widely used in a variety of applications, such as smart phones, personal computers, and electronic book readers. However, according to usage scenarios of the applications, different types of display devices may be chosen. To generate a desired image, a display device usually arranges its pixels in an array, and the pixels are updated to receive the pixel voltages separately and sequentially according to the image data. Then the pixels will display different gray levels according to the pixel voltages received.

In some situations, the display device may display a still image. In this case, power is wasted if the pixels are updated with the same data. Therefore, memory in pixel (MIP) circuits are usually used to store the pixel voltages of the image data so the pixels can be refreshed accordingly without repeated updating operations, reducing the power consumption. However in prior art, to control the display device, the pixel circuit of the display device will require a number of control elements, increasing the impedance on the charging path and resulting in a high power consumption.

SUMMARY OF THE DISCLOSURE

One embodiment of the present disclosure discloses a display device. The display device includes a display panel.

The display panel includes a source line, a common line, agate line, and a pixel circuit.

The pixel circuit includes a pixel control unit, a first switching unit, an inverter, a first memory capacitor, a second switching unit, and a pixel capacitor.

The pixel control unit has a first terminal and a second terminal, wherein the first terminal of the pixel control unit is coupled to the source line and the control terminal of the pixel control unit is coupled to the gate line. The first switching unit has a first terminal and a second terminal, wherein the first terminal of the first switching unit is coupled to the second terminal of the pixel control unit. The inverter has an input terminal and an output terminal, wherein the input terminal of the inverter is coupled to the second terminal of the first switching unit. The first memory capacitor has a first terminal and a second terminal, wherein the first terminal of the first memory capacitor is coupled to the first terminal of the first switching unit. The second switching unit has a first terminal and a second terminal, wherein the first terminal of the second switching unit is coupled to the pixel control unit, and the second terminal of the second switching unit is coupled to the output terminal of the inverter. The pixel capacitor has a first terminal and a second terminal, wherein the first terminal of the pixel capacitor is coupled to the common line, and the second terminal of the pixel capacitor is coupled to the output terminal of the inverter.

Another embodiment of the present disclosure discloses a display panel. The display panel includes a pixel circuit, and the pixel circuit includes a pixel control unit, a first switching unit, an inverter, a memory capacitor, a second switching unit, and a pixel capacitor.

The pixel control unit has a first terminal and a second terminal, wherein the first terminal of the pixel control unit is coupled to the source line and the control terminal of the pixel control unit is coupled to the gate line. The first switching unit has a first terminal and a second terminal, wherein the first terminal of the first switching unit is coupled to the second terminal of the pixel control unit. The inverter has an input terminal and an output terminal, wherein the input terminal of the inverter is coupled to the second terminal of the first switching unit. The first memory capacitor has a first terminal and a second terminal, wherein the first terminal of the first memory capacitor is coupled to the first terminal of the first switching unit. The second switching unit has a first terminal and a second terminal, wherein the first terminal of the second switching unit is coupled to the pixel control unit, and the second terminal of the second switching unit is coupled to the output terminal of the inverter. The pixel capacitor has a first terminal and a second terminal, wherein the first terminal of the pixel capacitor is coupled to the common line, and the second terminal of the pixel capacitor is coupled to the output terminal of the inverter.

These and other objectives of the present disclosure will no doubt become obvious to those of ordinary skill in the art after reading the following detailed description of the embodiment that is illustrated in the various figures and drawings.

DETAILED DESCRIPTION

Figure 1:
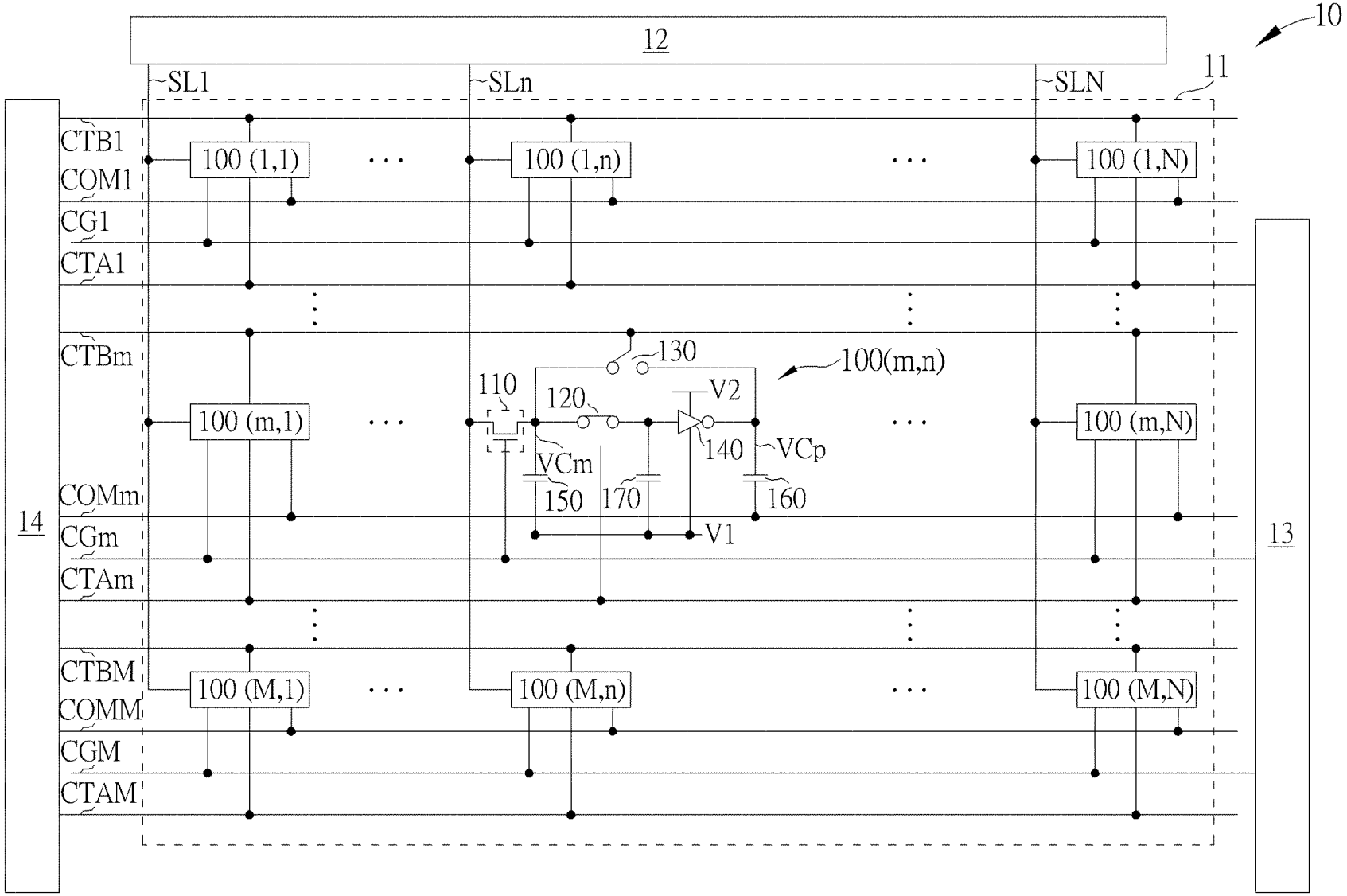
FIG. 1 shows a display device according to one embodiment of the present disclosure.

FIG. 1 shows a display device 10 according to one embodiment of the present disclosure. The display device 10 includes a display panel, a source driver 12, a gate driver 13, and a control driver 14. The display panel includes a pixel array 11. In some embodiments, the gate driver 13 and the control driver 14 can be integrated. Also, in some embodiments, the source driver 12, the gate driver 13 and the control driver 14 can be integrated.

The pixel array 11 includes N source lines SL1 to SLN, M common lines COM1 to COMM, M gate lines CG1 to CGM, M first control lines CTA1 to CTAM, M second control lines CTB1 to CTBM, and M×N pixel circuits 100(1,1) to 100(M,N) arranged in a matrix. M and N are integers greater than 1. Each of the pixel circuits 100(1,1) to 100(M,N) is coupled to a corresponding source line, a corresponding common line, a corresponding gate line, a corresponding first control line, and a corresponding second control line.

In FIG. 1, pixel circuits in the same row can be coupled to the same common line, the same gate line, the same first control line, the same second control line, and different source lines.

For example, the pixel circuits 100(1,1) to 100(1,N) are disposed in the same row, and the pixel circuits 100(M,1) to 100(M,N) are disposed in the same row. The pixel circuits 100(1,1) to 100(1,N) are coupled to the common line COM1, the gate line CG1, the first control line CTA1, and the second control line CTB1. However, the pixel circuit 100(1,1) is coupled to the source line SL1 while the pixel circuit 100(1,N) is coupled to the source line SLN. Similarly, the pixel circuits 100(M,1) to 100(M,N) are coupled to the common line COMM, the gate line CGM, the first control line CTAM, and the second control line CTBM. However, the pixel circuit 100(M,1) is coupled to the source line SL1 while the pixel circuit 100(M,N) is coupled to the source line SLN.

The source driver 12 can drive the source lines SL1 to SLN, the gate driver 13 can drive the gate lines CG1 to CGM, and the control driver 14 can drive the first control lines CTA1 to CTAM, and the second control lines CTB1 to CTBM. In some embodiments, the control driver 14 may include different control circuits for controlling different control lines. Also, the common lines COM1 to COMM may be driven by the control driver 14 or another control driver according to the system requirements in some embodiments. Also, in some embodiments, the gate driver 13 and the control driver 14 may be integrated. However, this is not to limit the implementation of the source driver 12, the gate driver 13, and the control driver 14. In some embodiments, the source driver 12, the gate driver 13 and the control driver 14 can all be integrated.

As is made as an example, the function blocks of the pixel circuit 100(*m,n*) in the display device 10 is shown in FIG. 1, wherein m is a positive integer no greater than M, and n is a positive integer no greater than N. The pixel circuit 100(*m,n*) includes a pixel control unit 110, a first switching unit 120, a second switching unit 130, an inverter 140, a first memory capacitor 150, and a pixel capacitor 160.

The pixel control unit 110 has a first terminal, a second terminal and a control terminal. The first terminal of the pixel control unit is coupled to the source line SLn and the control terminal of the pixel control unit is coupled to the gate line CGm. The first switching unit 120 has a first terminal and a second terminal. The first terminal of the first switching unit 120 is coupled to the second terminal of the pixel control unit 110. The inverter 140 has an input terminal, and an output terminal. The input terminal of the inverter 140 is coupled to the second terminal of the first switching unit 120. The first memory capacitor 150 has a first terminal and a second terminal. The first terminal of the first memory capacitor 150 is coupled to the first terminal of the first switching unit 120, and the second terminal of the first memory capacitor 150 is configured to receive a first voltage V1. The first voltage V1 can be a system reference voltage, for example but not limited to a ground voltage. The second switching unit 130 has a first terminal and a second terminal. The first terminal of the second switching unit 130 is coupled to the second terminal of the pixel control unit 110, and the second terminal of the second switching unit 130 is coupled to the output terminal of the inverter 140. The pixel capacitor 160 has a first terminal and a second terminal. The first terminal of the pixel capacitor 160 is coupled to a common line COMm, and the second terminal of the pixel capacitor 160 is coupled to the output terminal of the inverter 140.

The first switching unit 120 can be turned on or turned off according to the voltage of the first control line CTAm, and the second switching unit 130 can be turned on or turned off according to voltage of the second control line CTBm.

Figure 2:
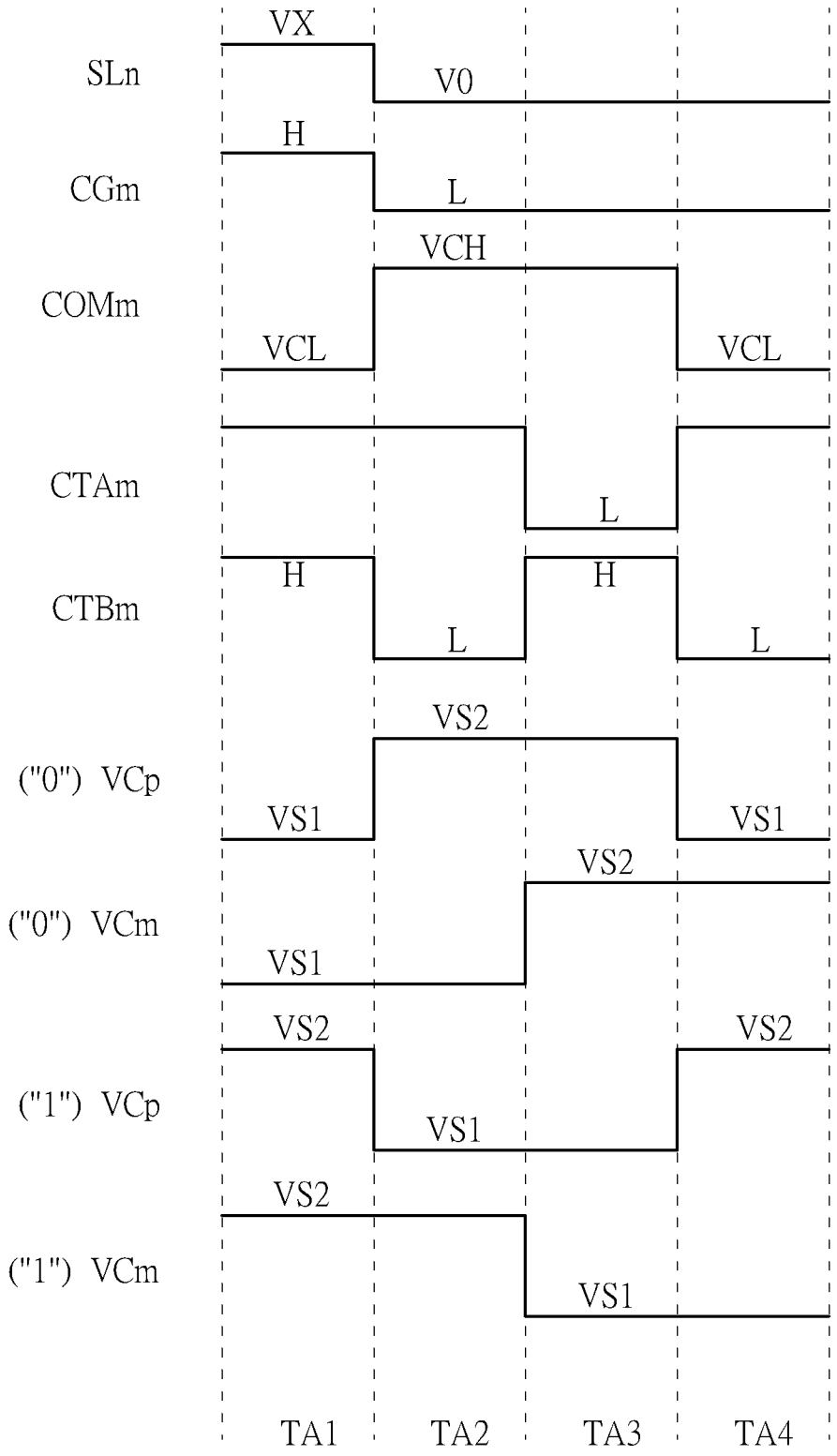
FIG. 2 shows a timing diagram of the voltages received by the pixel circuit in FIG. 1 during a writing and a refreshing process.

FIG. 2 shows a timing diagram of the voltages received by the pixel circuit 100(*m,n*), the voltage VCm at the second terminal of the first memory capacitor 150 and the voltage VCp at the second terminal of the pixel capacitor 160 for the pixel circuit 100(*m,n*) with different image data during a writing and a refreshing process.

In the present embodiment, the phrase "turn off" can include both the case that the voltage is changed for turning off a switch that was turned on previously, and the case that the voltage remains the same for ensuring a previous turned off switch remains at the same status. That is, after the operation of "turn off", the switch would be turned off regardless the previous status.

Similarly, the phrase "turn on" can include both the case that the voltage is changed for turning on a switch that was turned off previously, and the case that the voltage remains the same for ensuring a previous turned on switch remains at the same status. That is, after the operation of "turn on", the switch would be turned on regardless the previous status.

In the present embodiment, the first switching unit 120 can be turned on when the voltage of the first control line CTAm is at the high voltage H, and can be turned off when the voltage of the first control line CTAm is at the low voltage L lower than the high voltage H. Similarly, the second switching unit 130 can be turned on when the voltage of the second control line CTBm is at the high voltage H, and can be turned off when the voltage of the second control line CTBm is at the low voltage L.

During the time period TA1, the pixel circuit 100(*m,n*) is in the writing process. In this case, the voltage of the source line SLn is at a data voltage VX to be written to the pixel circuit 100(*m,n*), the voltage of the gate line CGm is at the high voltage H, the voltage of the common line COMm is at the first polarity voltage VCL, and the voltages of both the first control line CTAm and the second control line CTBm are at the high voltage H. Therefore, the pixel control unit 110 is turned on, the first switching unit 120 is turned on, and the second switching unit 130 is turned on.

Also, during the time period TA1, the inverter 140 can be disabled so that the inverter 140 will not perform the inversion function. Thus, even with the first switching unit 120 being turned on, the data voltage VX can still be applied to the second terminal of the pixel capacitor 160 from the source line SLn through the pixel control unit 110 and the second switching unit 130. In some embodiments, if the first switching unit 120 is turned off during the time period TA1, the data voltage VX can still be transmitted to the pixel capacitor 160 through the pixel control unit 110 and the second switching unit 130. Meanwhile, the first terminal of the pixel capacitor 160 would receive the first polarity voltage VCL from the common line COMm.

That is, when the pixel circuit 100(*m,n*) is written during the time period TA1, the pixel voltage received by the pixel circuit 100(*m,n*) would be the voltage difference between the first polarity voltage VCL and the data voltage VX, and the pixel circuit 100(*m,n*) will present different gray levels corresponding to the pixel voltages received.

In the present embodiment, the pixel circuit 100(*m,n*) can support 1-bit image data. That is, the image data stored in the pixel circuit 100(*m,n*) can be "0" or "1" (for example, representing the low gray level or the high gray level), and the corresponding data voltage can be the first data voltage VS1 and the second data voltage VS2 when the polarity voltage is at the first polarity voltage VCL. For example, in FIG. 2, if the voltage data VX is the first data voltage VS1, the pixel circuit 100(*m,n*) would be written with the image data "0", and the voltage VCp and VCm are at the first data voltage VS1 during the time period TA1. Similarly, if the voltage data VX is the second data voltage VS2, the pixel circuit 100(*m,n*) would be written with the image data "1", and the voltage VCp and VCm are at the second data voltage VS2 during the time period TA1.

In some embodiments, the first data voltage VS1 can be 0V, the second data voltage VS2 can be 5V, and the first polarity voltage VCL can be 0V, however, in other embodiments, the first data voltage VS1, the second data voltage VS2, and the first polarity voltage VCL may have other values according to the system requirement.

After the pixel circuit 100(*m,n*) is written with the desired image data, if the display device 10 is meant to present the same image for a period of time, a refreshing process may be applied to the pixel circuits 100(*m,n*), saving power consumption caused by repeated writing operations.

In FIG. 2, during the refreshing process in the time period TA2, the voltage of the common line COMm is inversed from the first polarity voltage VCL to the second polarity voltage VCH. In the present embodiment, the second polarity voltage VCH can be higher than the first polarity voltage VCL. Also, in the time period TA2, the gate line CGm is at the low voltage L, the voltage of the first control line CTAm is at the high voltage H, and the voltage of the second control line CTBm is changed to the low voltage L. Also, the inverter 140 is enabled to perform the inversion function.

In this case, the pixel control unit 110 is turned off, the first switching unit 120 is turned on, and the second switching unit 130 is turned off. The inverter 140 receives the voltage VCm, and outputs an inversed voltage to the second terminal of the pixel capacitor 160. For example, if the pixel circuit 100(*m,n*) stores the image data "0", then the voltage VCm would be at the first data voltage VS1 while the voltage VCp would be raised to the second voltage VS2 by the inverter 140. Similarly, if the pixel circuit 100(*m,n*) stores the image data "1", then the voltage VCm would be at the second data voltage VS2 while the voltage VCp would be pulled down to first voltage VS1 by the inverter 140.

Also, during the period TA2, since the voltage of the common line COMm is inversed to be the second polarity voltage VCH, which can be 5V in the present embodiment, the pixel voltage received by the pixel circuit 100(*m,n*) remains the same magnitude, preserving the same gray level.

During the time period TA3 following the time period TA2, the voltage of the first control line CTAm is changed to the low voltage L, and the voltage of the second control line CTBm is changed to the high voltage H. Also, the pixel control unit 110 remains turned off.

In this case, the first switching unit 120 is turned off, and the second switching unit 130 is turned on. Since the time period TA3 is rather short, the inverter 140 can still output the inversed voltage because of the parasitic capacitance of the first switching unit 120. Therefore, the inverter 140 can output an inversed voltage to the first terminal of the first memory capacitor 150 through the second switching unit 130. Since the first switching unit 120 is turned off, the voltage of the input terminal of the inverter 140 will not be changed as the voltage VCm, and the voltage VCp can remain at the inversed voltage outputted by the inverter 140. And the inversed voltage is at the same voltage as in the previous time period TA2.

During the time period TA4 following the time period TA3, the voltage of the common line COMm is inversed from the second polarity voltage VCH to the first polarity voltage VCL, the voltage of the first control line CTAm is changed to the high voltage H, and the voltage of the second control line CTBm is changed to the low voltage L. Also, the pixel control unit 110 remains turned off, and the inverter 140 keeps enabled.

In this case, the first switching unit 120 is turned on, and the second switching unit 130 is turned off. Therefore, the inverter 140 would receive the voltage VCm through the first switching unit 120, and output an inversed voltage to the second terminal of the pixel capacitor 160. For example, if the pixel circuit 100(*m,n*) stores the image data "0", then the voltage VCm would be at the second data voltage VS2 while the voltage VCp would be changed to the first voltage VS1 due to the inverter 140. Similarly, if the pixel circuit 100(*m,n*) stores the image data "1", then the voltage VCm would be at the first data voltage VS1 while the voltage VCp would be changed to the second voltage VS2 due to the inverter 140.

Since the voltage of the common line COMm is inversed to be the first polarity voltage VCL again during the time period TA4, the pixel voltage received by the pixel circuit 100(*m,n*) can be refreshed accordingly, that is, the pixel voltage received by the pixel circuit 100(*m,n*) can be preserved with the memory in pixel.

According to the pixel circuit 100(*m,n*), since the pixel capacitor 160 can receive the data voltage from the inverter 140 directly without additional switching unites in the refreshing process the impedance on the charging path to the pixel capacitor 160 can be reduced, saving the power consumption.

In some embodiments, to ensure that the inverter 140 can stably output the inversed voltage to the memory capacitor 150 during the time period TA3, a second memory capacitor 170 can be added to the pixel circuit 100(*m,n*) as shown in FIG. 1.

In FIG. 1, the second memory capacitor 170 has a first terminal and a second terminal. The first terminal of the second memory capacitor 170 is coupled to the second terminal of the first switching unit 120, and the second terminal of the second memory capacitor 170 is coupled to the second terminal of the first memory capacitor 150 for receiving the first voltage V1. Thus, when the first switching unit 120 is turned off during the time period TA3, the second memory capacitor 170 can provide the voltage received in the previous time period TA2, and the inverter 140 can output the desired data voltage stably to the pixel capacitor 160, ensuring the voltage VCp to be at the desired voltage level. However, in some embodiments, the second memory capacitor 170 can be saved according to the system requirement. For example, if the parasitic capacitor at the input terminal of the inverter 140 is large enough, then the second memory capacitor 170 may be omitted. In the following embodiments, the second memory capacitor 170 is removed, however, the second memory capacitor 170 can be added if needed.

Figure 3:
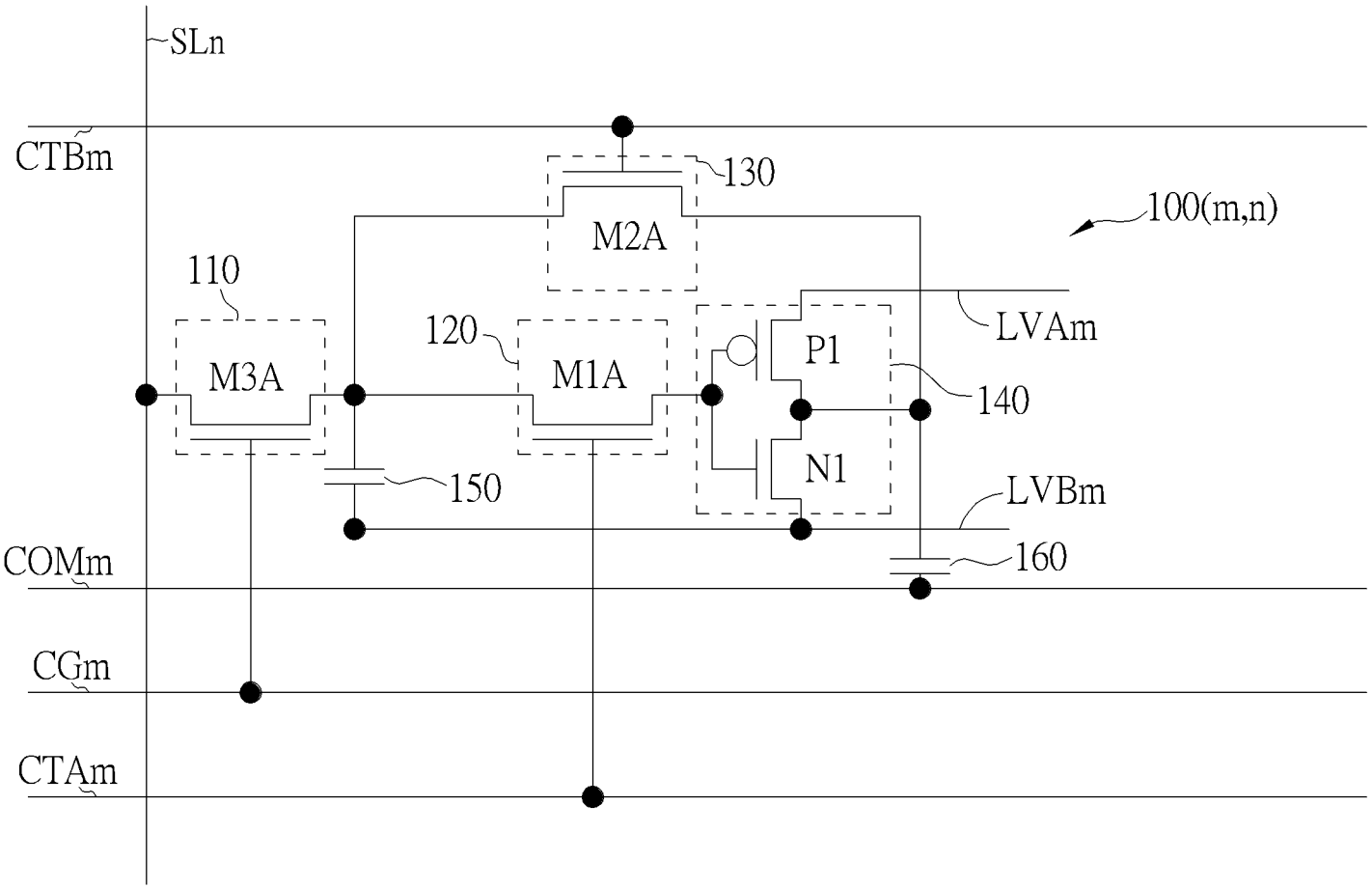
FIG. 3 shows a pixel circuit according to one embodiment of the present disclosure.

FIG. 3 shows the pixel circuit 100(*m,n*) according to one embodiment of the present disclosure. In FIG. 3, the first switching unit 120 includes a first transistor MIA having a first terminal, a second terminal, and a control terminal. The first terminal of the first transistor MIA is coupled to the first terminal of the first switching unit 120, and the second terminal of the first transistor MIA is coupled to the second terminal of the first switching unit 120. The second switching unit 130 includes a second transistor M2A having a first terminal, a second terminal, and a control terminal. The first terminal of the second transistor M2A is coupled to the first terminal of the second switching unit 130, and the second terminal of the second transistor M2A is coupled to the second terminal of the second switching unit 130. The pixel control unit 110 includes a third transistor M3A having a first terminal, a second terminal, and a control terminal. The first terminal of the third transistor M3A is coupled to the first terminal of the pixel control unit, the second terminal of the third transistor M3A is coupled to the second terminal of the pixel control unit, and the control terminal of the third transistor M3A is coupled to the control terminal of the pixel control unit.

Also, the inverter 140 includes a P-type transistor P1 and an N-type transistor N1. The P-type transistor P1 has a first terminal, a second terminal, and a control terminal. The first terminal of the P-type transistor P1 is coupled to a first voltage line LVAm, the second terminal of the P-type transistor P1 is coupled to the output terminal of the inverter 140, and the control terminal of the P-type transistor P1 is coupled to the input terminal of the inverter 140. The N-type transistor N1 has a first terminal, a second terminal, and a control terminal. The first terminal of the N-type transistor N1 is coupled to the second terminal of the P-type transistor P1, the second terminal of the N type-transistor N1 is coupled to a second voltage line LVBm, and the control terminal of the N-type transistor N1 is coupled to the input terminal of the inverter 140.

In FIG. 3, the control terminal of the first transistor MIA and the control terminal of the second transistor M2A are respectively coupled to the first control line CTAm and the second control line CTBm. Also, the first transistor MIA and the second transistor M2A are N-type transistors; therefore, the operations shown in FIG. 2 can be applied to the pixel circuit 100(*m,n*) shown in FIG. 3 directly.

In addition, when applying the operations shown in FIG. 2 to the pixel circuit 100(*m,n*) shown in FIG. 3, the inverter 140 can be disabled during the time period TA1 by sending the first voltage V1 to the first voltage line LVAm and sending the second voltage V2 to the second voltage line LVBm, wherein the first voltage V1 can be the system low voltage, and the second voltage V2 can be the system high voltage. For example, the first voltage V1 can be 0V and the second voltage V2 can be 5V. Similarly, the inverter 140 can be enabled during the time period TA2 to time period TA4 by sending the second voltage V2 to the first voltage line LVAm and sending the first voltage V1 to the second voltage line LVBm.

Figure 4:
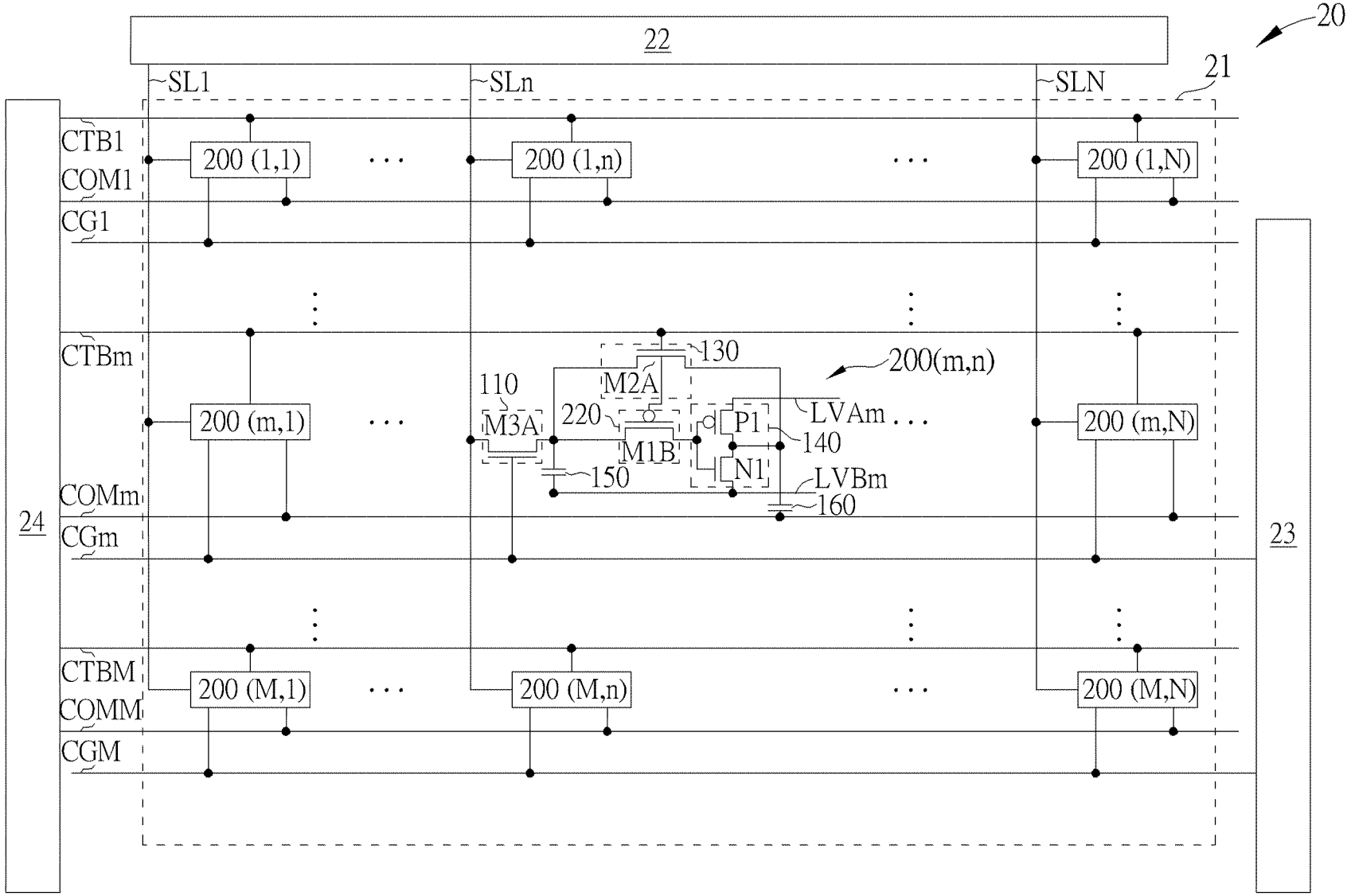
FIG. 4 shows a display device according to one embodiment of the present disclosure.

FIG. 4 shows a display device 20 according to one embodiment of the present disclosure. The display device 20 includes a display panel, a source driver 22, a gate driver 23, and a control driver 24, and the display panel includes a pixel array 21. The display device 20 and the display device 10 have similar structures and similar operation principles.

Also, in some embodiments, the gate driver 23 and the control driver 24 may be integrated. However, this is not to limit the implementation of the source driver 22, the gate driver 23, and the control driver 24. In some embodiments, the source driver 22, the gate driver 23 and the control driver 24 can all be integrated.

The pixel array 21 includes N source lines SL1 to SLN, M common lines COM1 to COMM, M gate lines CG1 to CGM, M second control lines CTB1 to CTBM, and M×N pixel circuits 200(1,1) to 200(M,N) arranged in a matrix. M and N are integers greater than 1. Each of the pixel circuits 200(1,1) to 200(M,N) is coupled to a corresponding source line, a corresponding common line, a corresponding gate line, and a corresponding second control line.

The pixel circuits 100(1,1) to 100(M,N) and the pixel circuits 200(1,1) to 200(M,N) have similar structures. However, the main difference between, for example, the pixel circuit 100(*m,n*) and the pixel circuit 200(*m,n*) is in that the first transistor M1B of the first switching unit 220 and the second transistor M2A of the second switching unit 130 in the pixel circuit 200(*m,n*) are of different types. That is, the first transistor M1B is a P-type transistor while the second transistor M2A is an N-type transistor. In this case, the control terminal of the first transistor M1B and the control terminal of the second transistor M2A can both be coupled to the second control line CTBm, while the first transistor M1B and the second transistor M2A will be turned on and turned off in an opposite manner.

The pixel circuit 200(*m,n*) can be operated with the same voltages shown in FIG. 2. Although the first transistor M1B may be turned off during the time period TA1 in FIG. 2, the writing operation can still be performed correctly.

Since the first transistor M1B and the second transistor M2A can be controlled by the same control line, the design of the display device 20 using pixel circuits 200(1,1) to 200(M,N) can be further simplified.

Figure 5:
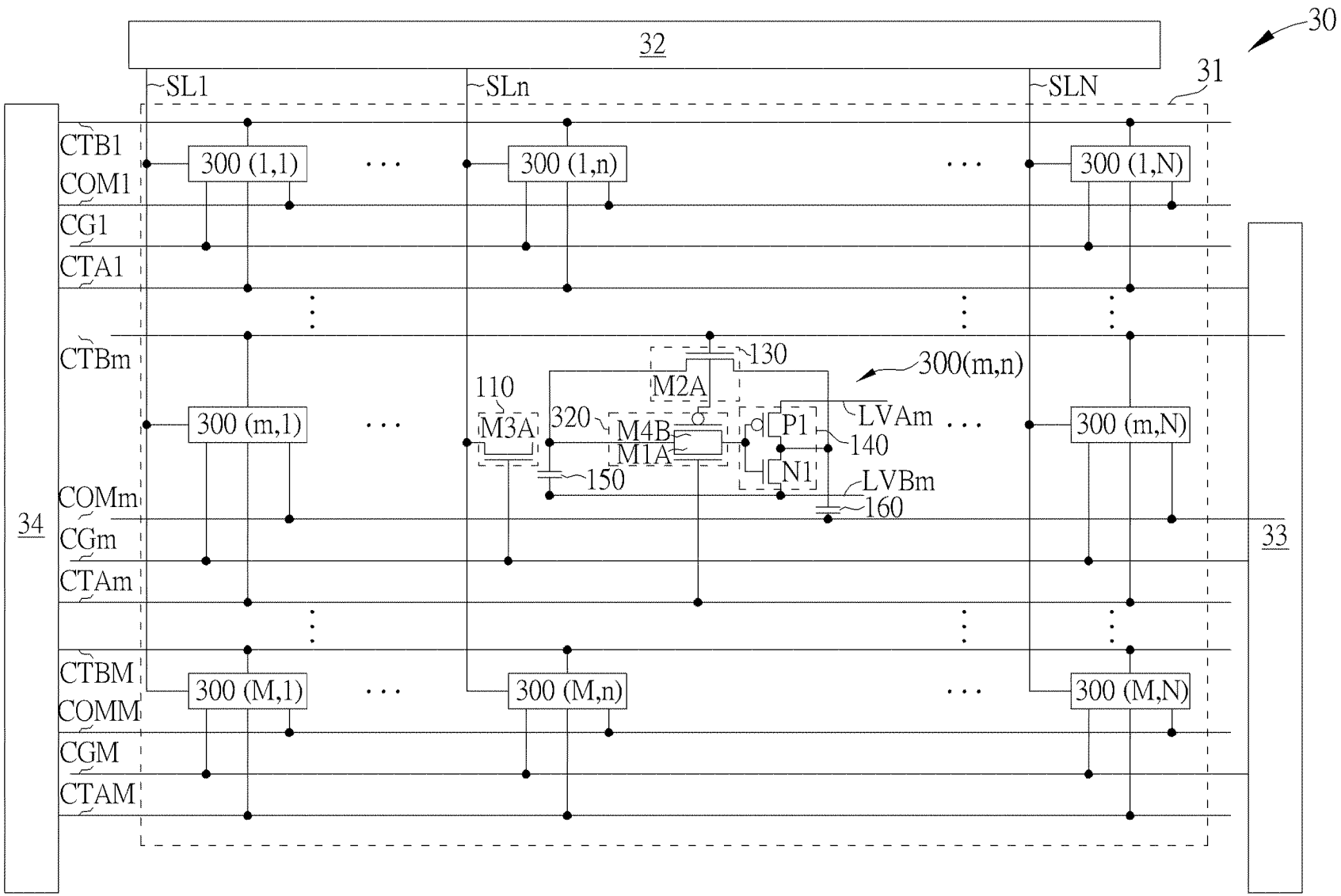
FIG. 5 shows a display device according to one embodiment of the present disclosure.

FIG. 5 shows a display device 30 according to another embodiment of the present disclosure. The display device 30 includes a display panel, a source driver 32, a gate driver 33, and a control driver 34, and the display panel includes a pixel array 31. The display device 30 and the display device 10 have similar structures and similar operation principles.

Also, in some embodiments, the gate driver 33 and the control driver 34 may be integrated. However, this is not to limit the implementation of the source driver 32, the gate driver 33, and the control driver 34. In some embodiments, the source driver 32, the gate driver 33 and the control driver 34 can all be integrated.

The pixel array 31 includes N source lines SL1 to SLN, M common lines COM1 to COMM, M gate lines CG1 to CGM, M first control lines CTA1 to CTAM, M second control lines CTB1 to CTBM, and M×N pixel circuits 300(1,1) to 300(M,N) arranged in a matrix. Each of the pixel circuits 300(1,1) to 300(M,N) is coupled to a corresponding source line, a corresponding common line, a corresponding gate line, a corresponding first control line, and a corresponding second control line.

The pixel circuits 100(1,1) to 100(M,N) and the pixel circuits 300(1,1) to 300(M,N) have similar structures. However, the main difference between, for example, the pixel circuit 100(*m,n*) and the pixel circuit 300(*m,n*) is in that the first switching unit 320 further includes a fourth transistor M4B. The fourth transistor M4B has a first terminal, a second terminal, and a control terminal. The fourth transistor M4B is a P-type transistor, the first terminal of the fourth transistor M4B is coupled to the first terminal of the first transistor M1A, the second terminal of the fourth transistor M4B is coupled to the second terminal of the first transistor M1A, and the control terminal of the fourth transistor M4B is coupled to the second control line CTBm.

The pixel circuit 300(*m,n*) can be operated with the same voltages shown in FIG. 2. During the time periods TA2 to TA4, the first transistor M1A and the fourth transistor M4B can both be turned on and both be turned off substantially simultaneously. Furthermore, since the first transistor M1A and the fourth transistor M4B are of different types of transistors, and have opposite turn-on voltages, the kickback effect can be avoided on the first switching unit 320, improving the pixel circuit 300(*m,n*) to present the gray level correctly.

Figure 6:
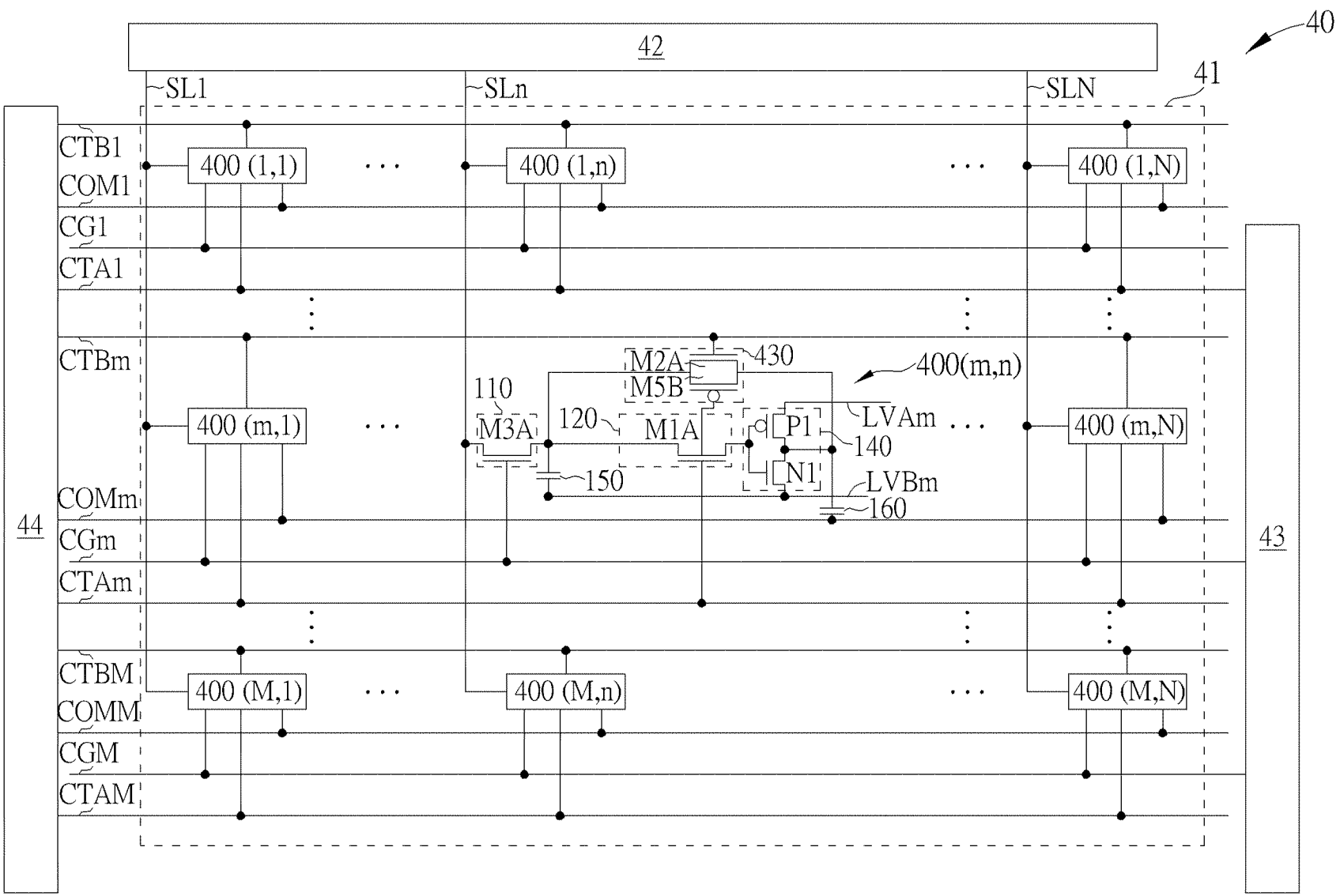
FIG. 6 shows a display device according to one embodiment of the present disclosure.

Similarly, the second switching unit may also include a P-type transistor to avoid the kickback effect. FIG. 6 shows a display device 40 according to another embodiment of the present disclosure. The display device 40 includes a display panel, a source driver 42, a gate driver 43, and a control driver 44, and the display panel includes a pixel array 41. The display device 40 and the display device 10 have similar structures and similar operation principles.

Also, in some embodiments, the gate driver 43 and the control driver 44 may be integrated. However, this is not to limit the implementation of the source driver 42, the gate driver 43, and the control driver 44. In some embodiments, the source driver 42, the gate driver 43 and the control driver 44 can all be integrated.

The pixel array 41 includes N source lines SL1 to SLN, M common lines COM1 to COMM, M gate lines CG1 to CGM, M first control lines CTA1 to CTAM, M second control lines CTB1 to CTBM, and M×N pixel circuits 400(1,1) to 400(M,N) arranged in a matrix. Each of the pixel circuits 400(1,1) to 400(M,N) is coupled to a corresponding source line, a corresponding common line, a corresponding gate line, a corresponding first control line, and a corresponding second control line.

The pixel circuits 100(1,1) to 100(M,N) and the pixel circuits 400(1,1) to 400(M,N) have similar structures. However, the main difference between, for example, the pixel circuit 100(*m,n*) and the pixel circuit 400(*m,n*) is in that the second switching unit 430 further includes a fifth transistor M5B. The fifth transistor M5B has a first terminal, a second terminal, and a control terminal. The fifth transistor M5B is a P-type transistor. The first terminal of the fifth transistor M5B is coupled to the first terminal of the second transistor M2A, the second terminal of the fifth transistor M5B is coupled to the second terminal of the second transistor M2A, and the control terminal of the fifth transistor M5B is coupled to the first control line CTAm.

The pixel circuit 400(*m,n*) can be operated with the same voltages shown in FIG. 2. During the time periods TA2 to TA4, the second transistor M2A and the fifth transistor M5B can both be turned on and both be turned off substantially simultaneously. Furthermore, since the second transistor M2A and the fifth transistor M5B are of different types of transistors, and have opposite turn-on voltages, the kickback effect can be avoided on the second switching unit 430, improving the pixel circuit 400(*m,n*) to present the gray level correctly.

Figure 7:
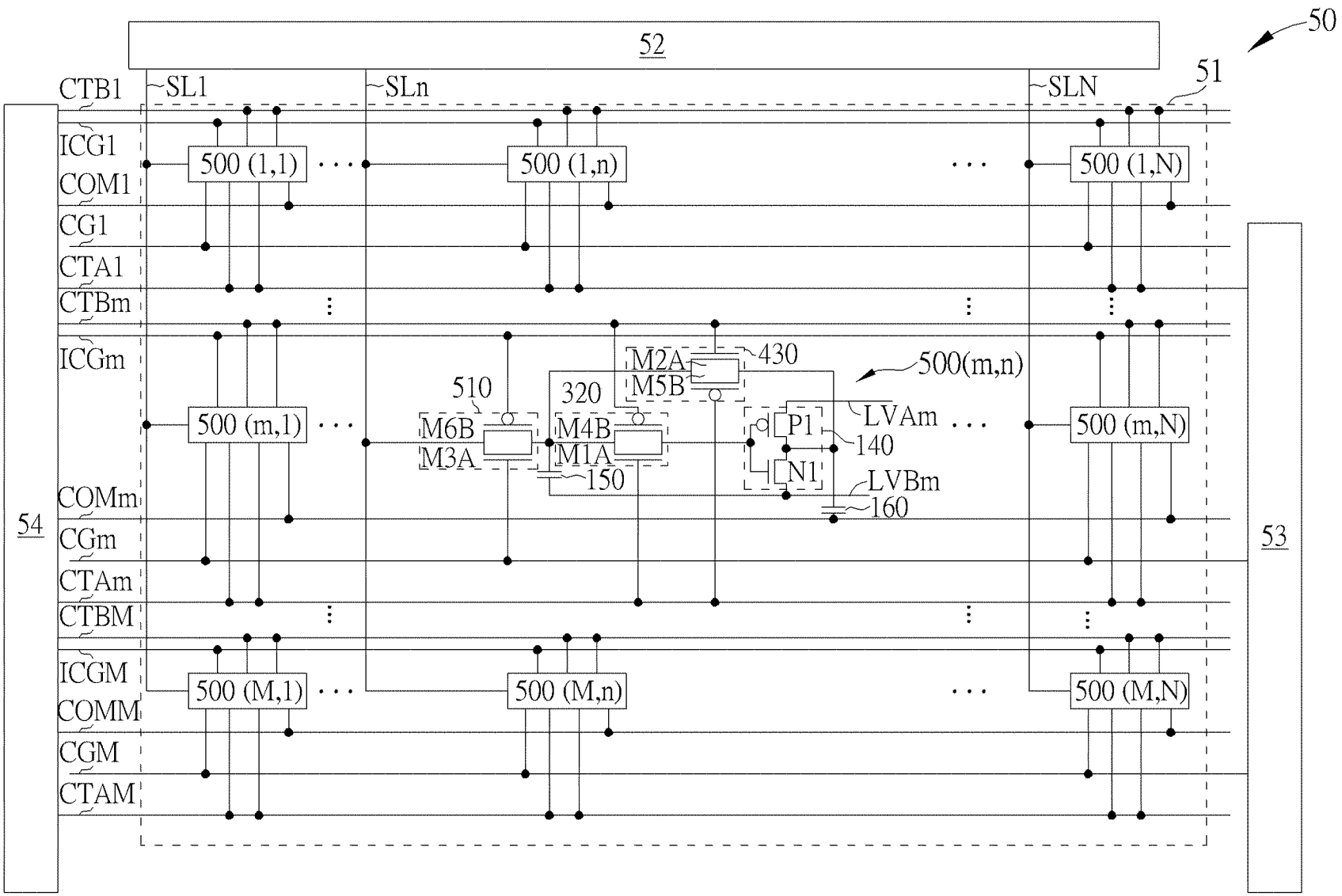
FIG. 7 shows a display device according to one embodiment of the present disclosure.

FIG. 7 shows a display device 50 according to another embodiment of the present disclosure. The display device 50 includes a display panel, a source driver 52, a gate driver 53, and a control driver 54, and the display panel includes a pixel array 51. The display device 50 and the display device 10 have similar structures and similar operation principles.

Also, in some embodiments, the gate driver 53 and the control driver 54 may be integrated. However, this is not to limit the implementation of the source driver 52, the gate driver 53, and the control driver 54. In some embodiments, the source driver 52, the gate driver 53 and the control driver 54 can all be integrated.

The pixel array 51 includes N source lines SL1 to SLN, M common lines COM1 to COMM, M gate lines CG1 to CGM, M first control lines CTA1 to CTAM, M second control lines CTB1 to CTBM, M inversed gate line ICG1 to ICGM, and M×N pixel circuits 500(1, 1) to 500(M,N) arranged in a matrix. Each of the pixel circuits 500(1,1) to 500(M,N) is coupled to a corresponding source line, a corresponding common line, a corresponding gate line, a corresponding inversed gate line, a corresponding first control line, and a corresponding second control line.

The pixel circuits 100(1,1) to 100(M,N) and the pixel circuits 500(1,1) to 500(M,N) have similar structures. However, the main difference between, for example, the pixel circuit 100(*m,n*) and the pixel circuit 500(*m,n*) is in that the first switching unit 320 further includes the fourth transistor M4B, the second switching unit 430 further includes the fifth transistor M5B, and the pixel control unit 510 further includes a sixth transistor M6B. The sixth transistor M6B has a first terminal, a second terminal, and a control terminal. The sixth transistor M6B is a P-type transistor. The first terminal of the sixth transistor M6B is coupled to the first terminal of the third transistor M3A, the second terminal of the sixth transistor M6B is coupled to the second terminal of the third transistor M3A, and the control terminal of the sixth transistor M6B is coupled to the inversed gate line ICGm. The voltage of the inversed gate line ICGm is always opposite with the voltage of the gate line CGm.

Therefore, the pixel circuit 500(*m,n*) can be operated with the same voltages shown in FIG. 2. Since the third transistor M3A and the sixth transistor M6B are of different types of transistors, and have opposite turn-on voltages, the kickback effect can be avoided on the pixel control unit 510. In addition, with the two different types of transistors, the kickback effect can also be reducing on the first switching unit 320 and the second switching unit 430, improving the pixel circuit 500(*m,n*) to present the gray level correctly.

In some embodiments, the pixel control unit can be implemented by pixel control unit 110 or pixel control unit 510, the first switching unit can be implemented by the first switching unit 120 or the first switching unit 320, and the second switching unit can be implemented by the second switching unit 130 or the second switching unit 430. The implementation of the pixel control unit, the first switching unit, and the second switching unit can be decided independently according to the system requirement.

Figure 8:
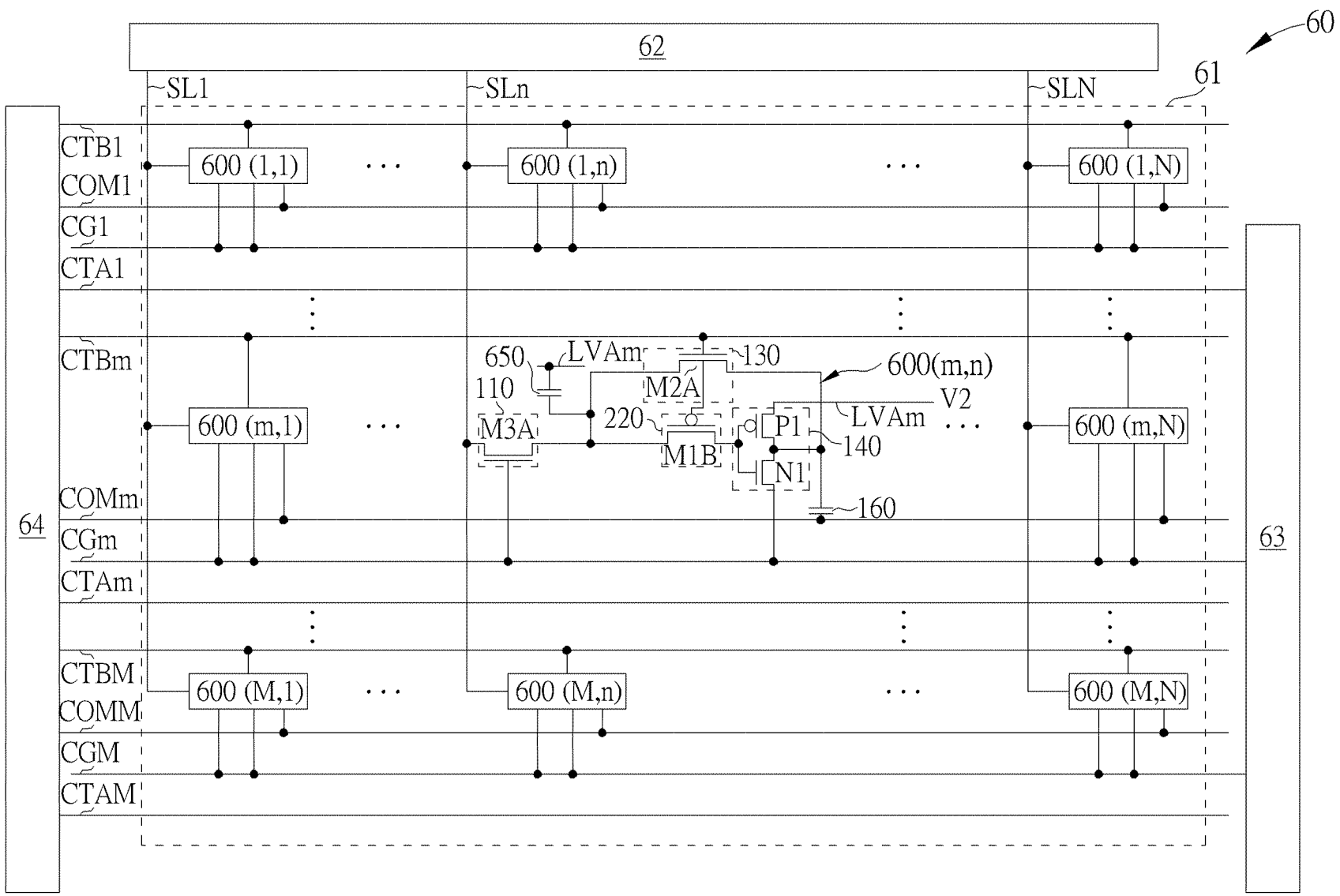
FIG. 8 shows a display device according to one embodiment of the present disclosure.

FIG. 8 shows a display device 60 according to another embodiment of the present disclosure. The display device 60 includes a display panel, a source driver 62, a gate driver 63, and a control driver 64, and the display panel includes a pixel array 61. The display device 60 and the display device 20 have similar structures and similar operation principles.

Also, in some embodiments, the gate driver 63 and the control driver 64 may be integrated. However, this is not to limit the implementation of the source driver 62, the gate driver 63, and the control driver 64. In some embodiments, the source driver 62, the gate driver 63 and the control driver 64 can all be integrated.

The pixel array 61 includes N source lines SL1 to SLN, M common lines COM1 to COMM, M gate lines CG1 to CGM, M second control lines CTB1 to CTBM, and M×N pixel circuits 600(1,1) to 600(M,N) arranged in a matrix. Each of the pixel circuits 600(1,1) to 600(M,N) is coupled to a corresponding source line, a corresponding common line, a corresponding gate line, and a corresponding second control line.

The pixel circuits 200(1,1) to 200(M,N) and the pixel circuits 600(1,1) to 600(M,N) have similar structures. However, the main difference between, for example, the pixel circuit 200(*m,n*) and the pixel circuit 600(*m,n*) is in that the second terminal of the first memory capacitor 650 is coupled to the first voltage line LVAm for receiving the second voltage V2. Also, the N-type transistor N1 of the inverter 140 is coupled to the gate line CGm.

The pixel circuit 600(*m,n*) can be operated with the same voltages shown in FIG. 2. Since the voltage of the gate line CGm is at the high voltage H when the pixel circuit 600(*m,n*) is in the writing process (time period TA1 as shown in FIG. 2), the inverter 140 can be disabled automatically. Also, since the voltage of the gate line CGm is at the low voltage L when the pixel circuit 600(*m,n*) performs the refreshing process (time periods TA2 to TA4 as shown in FIG. 2), the gate line CGm can replace the second voltage line LVBm for providing the low voltage L (or the first voltage V1), and the inverter 140 can be enabled accordingly. With the pixel circuit 600(*m,n*), the display device 60 may increase the pixel per inch (PPI). However, the pixel circuit 600(*m,n*) may not be able to present the some gray levels in some situations.

In summary, the display devices and the pixel circuits provided by the embodiments of the present disclosure can preserve the data voltage by inverters with low impedance paths during the refreshing process, saving the power consumption. Also, since the data voltage can be preserved by one inverter while no auxiliary capacitor coupled in parallel with the pixel capacitor is required, the circuit area can be rather small.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A display device comprising:

a display panel comprising:

plural source lines;

plural common lines;

plural gate lines; and plural pixel circuits, a pixel circuit of the plural pixel circuits comprising:

a pixel control unit having a first terminal, a second terminal, and a control terminal, wherein the first terminal of the pixel control unit is coupled to a source line of the plural source lines and the control terminal of the pixel control unit is coupled to a gate line of the plural gate lines;

a first switching unit having a first terminal and a second terminal, wherein the first terminal of the first switching unit is coupled to the second terminal of the pixel control unit;

an inverter having an input terminal and an output terminal, wherein the input terminal of the inverter is coupled to the second terminal of the first switching unit;

a first memory capacitor having a first terminal and a second terminal, wherein the first terminal of the first memory capacitor is coupled to the first terminal of the first switching unit;

a second switching unit having a first terminal and a second terminal, wherein the first terminal of the second switching unit is coupled to the pixel control unit, and the second terminal of the second switching unit is coupled to the output terminal of the inverter; and a pixel capacitor having a first terminal and a second terminal, wherein the first terminal of the pixel capacitor is coupled to a common line of the plural common lines, and the second terminal of the pixel capacitor is coupled to the output terminal of the inverter.

2. The display device of claim 1, wherein the pixel circuit further comprising:

a second memory capacitor having a first terminal and a second terminal, wherein the first terminal of the second memory capacitor is coupled to the second terminal of the first switching unit, and the second terminal of the second memory capacitor is coupled to the second terminal of the first memory capacitor.

3. The display device of claim 1, wherein:

the first switching unit comprises a first transistor having a first terminal, a second terminal, and a control terminal, wherein the first terminal of the first transistor is coupled to the first terminal of the first switching unit, and the second terminal of the first transistor is coupled to the second terminal of the first switching unit;

the second switching unit comprises a second transistor having a first terminal, a second terminal, and a control terminal, wherein the first terminal of the second transistor is coupled to the first terminal of the second switching unit, and the second terminal of the second transistor is coupled to the second terminal of the second switching unit; and the pixel control unit comprises a third transistor having a first terminal, a second terminal, and a control terminal, wherein the first terminal of the third transistor is coupled to the first terminal of the pixel control unit, the second terminal of the third transistor is coupled to the second terminal of the pixel control unit, and the control terminal of the third transistor is coupled to the control terminal of the pixel control unit.

4. The display device of claim 3, wherein:

the display panel further comprises plural control lines;

the first transistor and the second transistor are of a same type; and the control terminal of the first transistor and the control terminal of the second transistor are respectively coupled to two control lines of the plural control lines.

5. The display device of claim 3, wherein:

the display panel further comprises plural control lines;

the first transistor and the second transistor are two transistors of different types; and the control terminal of the first transistor and the control terminal of the second transistor are coupled to a control line of the plural control lines.

6. The display device of claim 3, wherein:

the display panel further comprises plural first control lines and plural second control lines;

the first transistor is an N-type transistor, and the control terminal of the first transistor is coupled to a first control line of the plural first control lines; and the first switching unit further comprises a fourth transistor having a first terminal, a second terminal, and a control terminal, wherein the fourth transistor is a P-type transistor, the first terminal of the fourth transistor is coupled to the first terminal of the first transistor, the second terminal of the fourth transistor is coupled to the second terminal of the first transistor, and the control terminal of the fourth transistor is coupled to a second control line of the plural second control lines.

7. The display device of claim 3, wherein:

the display panel further comprises plural first control lines and plural second control lines;

the second transistor is an N-type transistor, and the control terminal of the second transistor is coupled to a second control line of the plural second control lines; and the second switching unit further comprises a fifth transistor having a first terminal, a second terminal, and a control terminal, wherein the fifth transistor is a P-type transistor, the first terminal of the fifth transistor is coupled to the first terminal of the second transistor, the second terminal of the fifth transistor is coupled to the second terminal of the second transistor, and the control terminal of the fifth transistor is coupled to a first control line of the plural first control lines.

8. The display device of claim 3, wherein:

the display panel further comprises plural first control lines, plural second control lines and plural inversed gate lines;

the first transistor is an N-type transistor, and the control terminal of the first transistor is coupled to a first control line of the plural first control lines;

the first switching unit further comprises a fourth transistor having a first terminal, a second terminal, and a control terminal, wherein the fourth transistor is a P-type transistor, the first terminal of the fourth transistor is coupled to the first terminal of the first transistor, the second terminal of the fourth transistor is coupled to the second terminal of the first transistor, and the control terminal of the fourth transistor is coupled to a second control line of the plural second control lines;

the second transistor is an N-type transistor, and the control terminal of the second transistor is coupled to the second control line;

the second switching unit further comprises a fifth transistor having a first terminal, a second terminal, and a control terminal, wherein the fifth transistor is a P-type transistor, the first terminal of the fifth transistor is coupled to the first terminal of the second transistor, the second terminal of the fifth transistor is coupled to the second terminal of the second transistor, and the control terminal of the fifth transistor is coupled to the first control line;

the third transistor is an N-type transistor; and the pixel control unit further comprises a sixth transistor having a first terminal, a second terminal, and a control terminal, wherein the sixth transistor is a P-type transistor, the first terminal of the sixth transistor is coupled to the first terminal of the third transistor, the second terminal of the sixth transistor is coupled to the second terminal of the third transistor, and the control terminal of the sixth transistor is coupled to an inversed line of the plural inversed gate lines.

9. The display device of claim 1, wherein:

in a writing process, the pixel control unit is turned on, the second switching unit is turned on, and the inverter is disabled.

10. The display device of claim 9, wherein:

during a refreshing process after the writing process:

during a first time period, a voltage of the common line is inversed, the pixel control unit is turned off, the first switching unit is turned on, the second switching unit is turned off, and the inverter is enabled;

during a second time period following the first time period, the first switching unit is turned off, and the second switching unit is turned on; and during a third time period following the second time period, the voltage of the common line is inversed again, the first switching unit is turned on, and the second switching unit is turned off.

11. A display panel comprising:

plural source lines;

plural common lines;

plural gate lines; and plural pixel circuits, a pixel circuit of the plural pixel circuits comprising:

a pixel control unit having a first terminal, a second terminal, and a control terminal, wherein the first terminal of the pixel control unit is coupled to a source line of the plural source lines and the control terminal of the pixel control unit is coupled to a gate line of the plural gate lines;

a first switching unit having a first terminal and a second terminal, wherein the first terminal of the first switching unit is coupled to the second terminal of the pixel control unit;

an inverter having an input terminal and an output terminal, wherein the input terminal of the inverter is coupled to the second terminal of the first switching unit;

a first memory capacitor having a first terminal and a second terminal, wherein the first terminal of the first memory capacitor is coupled to the first terminal of the first switching unit;

a second switching unit having a first terminal and a second terminal, wherein the first terminal of the second switching unit is coupled to the pixel control unit, and the second terminal of the second switching unit is coupled to the output terminal of the inverter; and a pixel capacitor having a first terminal and a second terminal, wherein the first terminal of the pixel capacitor is coupled to a common line of the plural common lines, and the second terminal of the pixel capacitor is coupled to the output terminal of the inverter.

12. The display panel of claim 11, wherein the pixel circuit further comprises:

a second memory capacitor having a first terminal and a second terminal, wherein the first terminal of the second memory capacitor is coupled to the second terminal of the first switching unit, and the second terminal of the second memory capacitor is coupled to the second terminal of the first memory capacitor.

13. The display panel of claim 11, wherein:

the first switching unit comprises a first transistor having a first terminal, a second terminal, and a control terminal, wherein the first terminal of the first transistor is coupled to the first terminal of the first switching unit, and the second terminal of the first transistor is coupled to the second terminal of the first switching unit;

the second switching unit comprises a second transistor having a first terminal, a second terminal, and a control terminal, wherein the first terminal of the second transistor is coupled to the first terminal of the second switching unit, and the second terminal of the second transistor is coupled to the second terminal of the second switching unit; and the pixel control unit comprises a third transistor having a first terminal, a second terminal, and a control terminal, wherein the first terminal of the third transistor is coupled to the first terminal of the pixel control unit, the second terminal of the third transistor is coupled to the second terminal of the pixel control unit, and the control terminal of the third transistor is coupled to the control terminal of the pixel control unit.

14. The display panel of claim 13, further comprising plural control lines, wherein:

the first transistor and the second transistor are of a same type; and the control terminal of the first transistor and the control terminal of the second transistor are respectively coupled to two control lines of the plural control lines.

15. The display panel of claim 13, further comprising a plural control lines, wherein:

the first transistor and the second transistor are two transistors of different types; and the control terminal of the first transistor and the control terminal of the second transistor are coupled to a control line of the plural control lines.

16. The display panel of claim 13, further comprising a plural first control lines and plural second control lines, wherein:

the first transistor is an N-type transistor, and the control terminal of the first transistor is coupled to a first control line of the plural first control lines; and the first switching unit further comprises a fourth transistor having a first terminal, a second terminal, and a control terminal, wherein the fourth transistor is a P-type transistor, the first terminal of the fourth transistor is coupled to the first terminal of the first transistor, the second terminal of the fourth transistor is coupled to the second terminal of the first transistor, and the control terminal of the fourth transistor is coupled to a second control line of the plural second control lines.

17. The display panel of claim 13, further comprising plural first control lines and plural second control lines, wherein:

the second transistor is an N-type transistor, and the control terminal of the second transistor is coupled to a second control line of the plural second control lines; and the second switching unit further comprises a fifth transistor having a first terminal, a second terminal, and a control terminal, wherein the fifth transistor is a P-type transistor, the first terminal of the fifth transistor is coupled to the first terminal of the second transistor, the second terminal of the fifth transistor is coupled to the second terminal of the second transistor, and the control terminal of the fifth transistor is coupled to a first control line of the plural first control lines.

18. The display panel of claim 13, further comprising plural first control lines, plural second control lines and plural inversed gate lines, wherein:

the first transistor is an N-type transistor, and the control terminal of the first transistor is coupled to a first control line of the plural first control lines;

the first switching unit further comprises a fourth transistor having a first terminal, a second terminal, and a control terminal, wherein the fourth transistor is a P-type transistor, the first terminal of the fourth transistor is coupled to the first terminal of the first transistor, the second terminal of the fourth transistor is coupled to the second terminal of the first transistor, and the control terminal of the fourth transistor is coupled to a second control line of the plural second control lines;

the second transistor is an N-type transistor, and the control terminal of the second transistor is coupled to the second control line;

the second switching unit further comprises a fifth transistor having a first terminal, a second terminal, and a control terminal, wherein the fifth transistor is a P-type transistor, the first terminal of the fifth transistor is coupled to the first terminal of the second transistor, the second terminal of the fifth transistor is coupled to the second terminal of the second transistor, and the control terminal of the fifth transistor is coupled to the first control line;

the third transistor is an N-type transistor; and the pixel control unit further comprises a sixth transistor having a first terminal, a second terminal, and a control terminal, wherein the sixth transistor is a P-type transistor, the first terminal of the sixth transistor is coupled to the first terminal of the third transistor, the second terminal of the sixth transistor is coupled to the second terminal of the third transistor, and the control terminal of the sixth transistor is coupled to an inversed gate line of the plural inversed gate lines.

19. The display panel of claim 11, wherein:

in a writing process, the pixel control unit is turned on, the second switching unit is turned on, and the inverter is disabled.

20. The display panel of claim 19, wherein:

during a refreshing process after the writing process:

during a first time period, a voltage of the common line is inversed, the pixel control unit is turned off, the first switching unit is turned on, the second switching unit is turned off, and the inverter is enabled;

during a second time period following the first time period, the first switching unit is turned off, and the second switching unit is turned on; and during a third time period following the second time period, the voltage of the common line is inversed again, the first switching unit is turned on, and the second switching unit is turned off.

* * * * *